US005901837A

United States Patent [19]

Aimi

[11] Patent Number: 5,901,837

[45] Date of Patent: May 11, 1999

[54] PUSH BUTTON SWITCH AND MANUFACTURING METHOD OF THE SAME

[75] Inventor: Mituo Aimi, Osaka, Japan

[73] Assignee: Matsushita Electric Industrial Co., Ltd., Osaka, Japan

[21] Appl. No.: 09/073,832

[22] Filed: May 6, 1998

[30] Foreign Application Priority Data

May 29, 1997 [JP] Japan ..... 9-139498

[51] Int. Cl.[6] ..... H01H 13/70

[52] U.S. Cl. ..... 200/344; 29/622; 200/5 A

[58] Field of Search ..... 29/622; 200/341, 200/344, 345, 5 A, 512, 517; 400/490, 491, 491.2, 495, 495.1

[56] References Cited

U.S. PATENT DOCUMENTS

| | | | |
|---|---|---|---|
| 4,118,859 | 10/1978 | Busler | 29/622 |
| 4,314,113 | 2/1982 | Nelson | 200/5 R |
| 4,839,476 | 6/1989 | Okuno | 200/17 R |
| 5,215,187 | 6/1993 | Ping-Chieng et al. | 200/517 |
| 5,382,762 | 1/1995 | Mochizuki | 200/5 A |
| 5,555,971 | 9/1996 | Takada | 200/345 |
| 5,562,203 | 10/1996 | Mochizuki | 200/345 |
| 5,597,067 | 1/1997 | Yoneyama | 200/344 |
| 5,625,532 | 4/1997 | Sellers | 361/680 |
| 5,657,860 | 8/1997 | Koike et al. | 200/344 |
| 5,763,842 | 6/1998 | Tsai et al. | 200/5 A |

*Primary Examiner*—Michael A. Friedhofer
*Attorney, Agent, or Firm*—Pollock, Vande Sande & Amernick

[57] ABSTRACT

A link member consists of a set of frame bodies assembled in an X shape when seen from the side so as to be swingable each other. A base member is provided to support the link member. At least one of the link member and the base member is an elastic member which is interposed between a key top member and the opposed switch members. A spring-back force is obtained by the elastic member to restore the key top member and the link member to their original positions. Thus, the number of resin components is reduced. A push button switch reasonable in cost and low or short in size is provided.

24 Claims, 14 Drawing Sheets

PUSH BUTTON SWITCH AND MANUFACTURING METHOD OF THE SAME

BACKGROUND OF THE INVENTION

The present invention relates to a push button switch having a springback force which is preferably used as an input key for electronic devices, such as wordprocessors, personal computers or the like. Furthermore, the present invention relates to a method for manufacturing the push button switches.

A conventional push button switch will be explained with reference to FIGS. 17 to 20. FIG. 17 is a plan view showing a conventional push button switch. FIG. 18 is a cross-sectional view showing the same. FIG. 19 is a perspective view showing an assembled condition of a link member used in the push button switch. FIG. 20 is a cross-sectional view showing an operating condition of the push button switch.

In the drawings, reference numeral 1 denotes a metallic base plate. Reference numeral 2 denotes a switch member comprising two films printed with a conductive paste. One film is put on the other film to constitute opposed switch contacts. Reference numeral 3 denotes a dome portion that is resiliently deformable. A protrusion 3A, used for pushing the opposed switch contacts of the switch member 2, is provided on a reverse surface of the dome portion 3. Reference numeral 4 denotes a resin casing having a central portion with a guide hole 4A for the dome portion 3 and both end portions with a pair of engaging recesses 4B.

Reference numeral 5 denotes a key top member having a cylindrical stem 5A at a central portion on a lower surface thereof and a pair of engaging portions 5B at respective end portions on the lower surface. The cylindrical stem 5A is slidably coupled with the guide hole 4A of the casing 4.

Reference numerals 6 and 7 denote a set of frame bodies being rectangular resin members as shown in FIG. 19. Each frame body has both ends with cylindrical fulcrum portions 6A and 6B1 (6B2), or 7A and 7B1 (7B2). Parallel arms 6C1 and 6C2 or 7C1 and 7C2 are connected at one end by the fulcrum portions 6A and 7A. Cylindrical axes 6D1 and 6D2 are provided at central portions of respective arms 6C1 and 6C2 of the frame body 6. Elongated holes 7D1 and 7D2 are opened at central portions of respective arms 7C1 and 7C2 of the other frame body 7. The cylindrical axes 6D1 and 6D2 of the frame body 6 are rotatably and slidably coupled with the elongated holes 7D1 and 7D2 of the frame body 7, respectively. The frame bodies 6 and 7, as a set, are assembled in an X shape when seen from a side. Thus, the frame bodies 6 and 7, when connected in a crossover fashion, cooperatively constitute a link member 8.

The fulcrum portions 6A and 7A provided at the lower ends of the link member 8 are held rotatably and slidably between the engaging recesses 4B provided at the both ends of the casing 4 and the switch member 2.

On the other hand, the upper fulcrum portions 6B1, 6B2 and 7B1, 7B2 are held rotatably and slidably in a pair of corresponding engaging portions 5B provided at the both ends of the key top member 5.

Next, operation of the above-described push button switch will be explained. When the key top member 5 is depressed downward by a finger placed on the upper surface of the key top member 5, the link member 8 held by the engaging portions 5B rotates about the cylindrical fulcrum portions 6B1, 6B2 and 7B1, 7B2. The lower fulcrum portions 6A and 7A, held rotatably and slidably between the casing 4 and the switch member 2, rotate and slide along the engaging recesses 4B in response to the downward movement of the key top member 5.

The movements of respective frame bodies 6 and 7 constituting the link member 8 are linked with each other by the engagement between the circular axes 6D1 and 6D2 provided at the central portions of the arms 6C1 and 6C2 and the elongated holes 7D1 and 7D2 opened at the central portions of the arms 7C1 and 7C2. When the key top member 5 is pushed, the key top member 5 is depressed downward substantially keeping a horizontal position. The dome portion 3 is collapsed or flattened by the key top member 5. The protrusion 3A pushes the switch member 2 so as to generate a predetermined turn-on signal.

Thereafter, the key top member 5 is released from a depressing force applied thereon. Upon releasing the depressing force, the dome portion 3 restores to its original shape by its springback force. Both the link member 8 and the key top member 5, pushed upward by the dome portion 3, return to their original positions shown in FIG. 18.

According to the above-described push button switch, the X-shaped link member 8 is interposed between the key top member 5 and the casing 4. The up-and-down movement of the key top member 5 is performed via the intervening link member 8. This provides ease in operation. However, the resin casing 4 has the guide hole 4A for holding the dome portion 3 in position and the engaging recess 4B for holding the link member 8. Thus, an overall height of the resin casing 4 becomes too high to realize a thin casing.

Furthermore, using many resin parts is not preferable in that the material cost is increased.

SUMMARY OF THE INVENTION

To solve the foregoing problems encountered in the prior art, the present invention has an object to provide a push button switch capable of reducing the number of resin parts, reasonable in cost, and low or short in size. Furthermore, the present invention has an object to provide a method of manufacturing the push button switches.

In order to accomplish the above and other related objects, the present invention provides a push button switch comprising a link member consisting of a set of frame bodies assembled in an X shape when seen from the side so as to be swingable. A base member is provided to support the link member. At least one of the link member and the base member is an elastic member which is interposed between a key top member and the opposed switch contacts. A springback force is obtained by the elastic member to restore the key top member and the link member to their original positions.

According to the present invention, it becomes possible to provide a push button switch capable of reducing the number of resin parts, reasonable in cost, and low or short in size, as well as its manufacturing method.

Preferred features of the present invention will be explained hereinafter.

A first aspect of the present invention provides a push button switch comprising a key top member having an engaging portion at a lower surface thereof. A link member includes a pair of frame bodies assembled in an X shape when seen from its side face. Each frame body is swingable and has an upper end provided with an engaging means engageable with the engaging portion of the key top member. A base member supports a lower end portion of each frame body of the link member so that each frame body is rotatably hinged by the base member. Opposed switch members are located underneath the base member for cooperatively generating a turning-on signal in response to a predetermined pushing force applied thereon. And, at least one of the link member and the base member is an elastic member. The elastic member is resiliently deformed in response to a depressing force applied on the key top member so as to allow part of either the link member or the key top member to push the opposed switch members. The elastic member springs back to an original position upon releasing the depressing force applied on the key top member.

With this arrangement, either the link member or the base member is made of an elastic material resiliently deformable when the push button switch is depressed. This makes it possible to realize a push button switch capable of generating a sufficient elastic restoring force without relying on an elastic dome portion conventionally used, and low or short in size.

It is preferable that, when the key top member is depressed, paired engaging portions formed on the frame bodies assembled in the X shaped are lowered to an altitudinal level equivalent to a plane comprising two support portions of the base member provided for hingedly supporting the lower end portions of the frame bodies of the link member.

With this arrangement, the link member or the base member of an elastic material is resiliently deformed in response to a down stroke of the key top member. The increased deformation stress of the link member or the base member is substantially reduced to zero when the paired engaging portions of two frame bodies reach the above-described plane. This brings an appropriate click feeling during the depressing operation of the key top member.

Preferably, at least one of the link member and the base member is an elastic metal plate. This makes it possible to provide a reliable push button switch allowing adequate settings in an operation load or a restoring force of the key top member by applying a press working on the elastic metal plate, such as a stainless steel plate or a phosphor bronze plate.

Preferably, a resiliently deformable portion is provided adjacent to at least one of two support portions of the base member supporting the link member, or provided adjacent to at least one of the two lower end portions of the frame bodies of the link member supported by the base member. The resiliently deformable portion is deformed along a horizontal plane. This arrangement makes it possible to convert a lateral expanding motion of the link member into a horizontal elastic deformation when the key top member is depressed downward. Thus, the link member and the key top member can return to their original positions by the elastic restoring force given from the resiliently deformable portion.

Preferably, at least one of the two support portions of the base member supporting the link member is configured into a cantilever spring. This arrangement makes it possible to convert a lateral expanding motion of the link member into a stable elastic deformation of the cantilever spring when the key top member is depressed downward. Thus, it becomes possible to realize a push button switch having a stable elastic restoring force.

Preferably, at least one of the lower end portions of the frame bodies of the link member supported by the base member is configured into a cantilever spring.

Preferably, the lower end portions of the frame bodies of the link member and the two support portions of the base member are engaged at two portions, at least one of the two portions is constituted by a combination of the lower end portion and the support portion configured into cantilever springs, and a distal end of one cantilever spring is engaged with a proximal end of the other cantilever spring. According to this arrangement, it becomes possible to provide a push button switch having a large margin in its spring characteristics and therefore realizing a large deformation amount and a large operation load.

Preferably, resiliently deformable portions are provided adjacent to paired engaging portions of the two frame bodies constituting the link member. When the key top member is depressed downward, the paired engaging portions of the frame bodies are resiliently deformed so as to obtain a sufficient elastic restoring force for returning the link member and the key top member to their original positions.

Preferably, at least one of the paired engaging portions of the two frame bodies is configured into a cantilever spring. According to this arrangement, it becomes possible to realize a push button switch capable of generating an elastic restoring force stable in its spring characteristics.

Preferably, the paired engaging portions of the two frame bodies constituting the link member are configured into cantilever springs, and a distal end of one cantilever spring is engaged with a proximal end of the other cantilever spring. According to this arrangement, it becomes possible to provide a push button switch having a large margin in its spring characteristics and therefore realizing a large deformation amount and a large operation load.

Preferably, two support portions of the base member supporting the link member have a receiving portion with a hook portion, and the hook portion prevents the link member from disengaging from the base member. Accordingly, after the base member is assembled with the link member, it becomes possible to prevent the link member from being disengaged from the base member in a succeeding assembling process or when the key top member is installed on or detached from the link member.

Preferably, one of the two frame bodies constituting the link member has an L-shaped hook portion at paired engaging portions of the two frame bodies, and the L-shaped hook portion is inserted into an engaging hole of the other frame body when the two frame bodies are assembled and the L-shaped hook is bent in a predetermined direction so as to ensure engagement between the two frame bodies. With this arrangement, it becomes possible to surely prevent the frame bodies from being disengaged from each other during an assembling process or installation or detachment of the key top member.

Preferably, protrusions are formed at opposing inner side faces or at outer side faces of a top end portion of each of the frame bodies constituting the link member, and the key top member has recessed portions formed at a lower surface thereof. The recessed portions mutually face inward or outward directions so as to be resiliently clamped by the protrusions of the two frame bodies and allow the protrusions to rotate and slide. This arrangement makes it possible to easily install or detach the key top member on or from the upper end of the link member by utilizing the elasticity of the frame bodies constituting the link member.

Preferably, a contact pushing portion is formed on a lower surface of the key top member so that the opposed switch members are pushed by the contact pushing portion. According to this arrangement, the switch contacts can be directly pushed by the key top member. The switch is turned on when the key top member reaches the lowest point. This stabilizes the ON position of the switch with smaller dispersions. Furthermore, upon releasing a depressing force applied on the key top member, the opposed switch contacts push the contact pushing portion backward. Subsequently, the link member is returned to the original position by a resilient force given from the elastic material. In response to the restoring motion of the link member, the key top member is surely returned to its original position without being stopped at a depressed position.

Preferably, a contact pushing portion is formed on at least one of two frame bodies constituting the link member, so that the opposed switch members are pushed by the contact pushing portion. This arrangement makes it possible to surely turn on the switch in response to the depressing of the key top member, without increasing the number of parts. Furthermore, this arrangement makes it possible to perform an inspection of the switch contacts before installing the key top member. Moreover, upon releasing a depressing force applied on the key top member, the opposed switch contacts push the contact pushing portion backward. Subsequently, the link member is returned to the original position by a resilient force given from the elastic material. In response to the restoring motion of the link member, the key top member is surely returned to its original position without being stopped at a depressed position. Thus, the returning operation of the push button switch is surely performed.

Preferably, the contact pushing portion is a resiliently deformable cantilever spring. According to this arrangement, the contact pushing portion provided on the link member pushes the opposed switch contacts. Then, it is allowed that the key top member is further depressed deeply even after the switch is turned on. Namely, both ON and OFF positions of the push button switch in a depressing stroke of the key top member can be freely changed by adjusting the deflection amount of the cantilever spring.

Preferably, a projecting piece is provided on a lower surface of the base member, and the projecting piece is inserted into a fixing hole opened thoroughly across a rigid base plate so as to sandwich the opposed switch members between the base member and the base plate. According to this arrangement, the base member can be directly fixed to the rigid base plate. This stabilizes the installation size and strength. Thus, the switch operation is surely performed in response to an operation of the key top member.

A second aspect of the present invention provides a manufacturing method for the above-described push button switches. According to a manufacturing method of the present invention, a plurality of base member portions are formed continuously at predetermined pitches on a hooped elastic metal plate. Each link member is mounted on a corresponding base member portion on the hooped elastic metal plate by engaging lower end portions of the link member with support portions of a corresponding base member portion so that the link member is rotatably hinged about the support portions. A hooped switch member plate is assembled underneath the hooped elastic metal plate so as to adjust a mutual relationship between the base member portions and the opposed switch portions. The hooped switch member has a plurality of opposed switch portions formed thereon at the same pitches as the base member portions. A key top member is placed on each link member, thereby obtaining a plurality of push button switches connected in a hooped condition.

With this manufacturing method, the base members are continuously formed on the hooped elastic metal plate at predetermined pitches, for example, corresponding to key layout of a keyboard used for a personal computer. The opposed switch portions are formed on the hooped switch member at the same pitches as the base members. Thus, it becomes possible to assemble a plurality of push button switches connected in a hooped condition at a time by assembling the hooped elastic metal plate and the hooped switch member. An automated assembling for the push button switches can be easily realized.

According to manufacturing method of the present invention, a plurality of base member portions are formed continuously at predetermined pitches on a hooped elastic metal plate. Each link member is mounted on a corresponding base member portion on the hooped elastic metal plate by engaging lower end portions of the link member with support portions of a corresponding base member portion so that the link member is rotatably hinged about the support portions. Individual base members are separated from the hooped elastic metal plate. The separated base members are positioned or rearranged on a hooped switch member plate so as to correspond to a plurality of opposed switch portions formed thereon at predetermined pitches larger than the pitches of the continuous base member portions formed on the hooped elastic plate. And, a key top member is placed on each link member, thereby obtaining a plurality of push button switches connected in a hooped condition.

With this manufacturing method, the layout pitch on the hooped metal plate is effectively determined during a press working of the base members even when a used apparatus has larger key layout pitches. Namely, after separated into individual base members, the individual base members are placed on the hooped switch member so as to correspond to the opposed switch portions formed thereon at predetermined pitches, for example, corresponding to key layout of a keyboard used for a personal computer. Thus, it becomes possible to assemble a plurality of push button switches connected in a hooped condition at a time by arranging the separated base members on the hooped switch member. This manufacturing method makes it possible to flexibly arrange the push button switches according to required layout pitches by changing the switch member and the base plate.

BRIEF DESCRIPTION OF THE DRAWINGS

The above and other objects, features and advantages of the present invention will become more apparent from the following detailed description which is to be read in conjunction with the accompanying drawings, in which.

DESCRIPTION OF THE PREFERRED EMBODIMENTS

Figure 1:
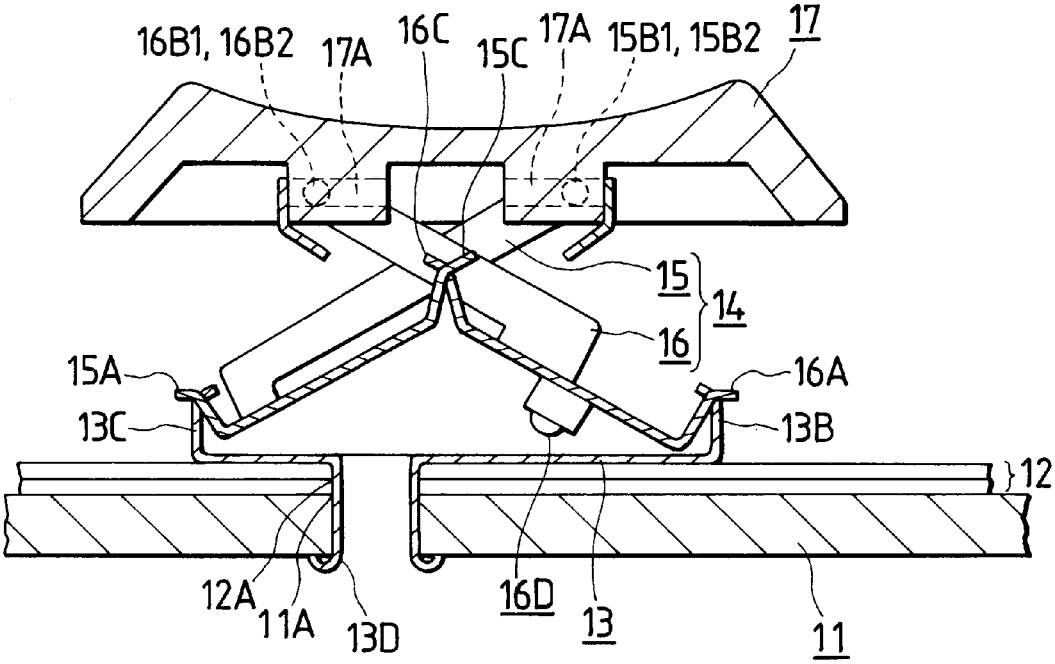
FIG. 1 is a cross-sectional view showing a push button switch in accordance with a first embodiment of the present invention.

Preferred embodiments of the present invention will be explained in more detail with reference to the accompanying drawings. Identical parts are denoted by the same reference numerals throughout the drawings.

First Embodiment

Figure 2:
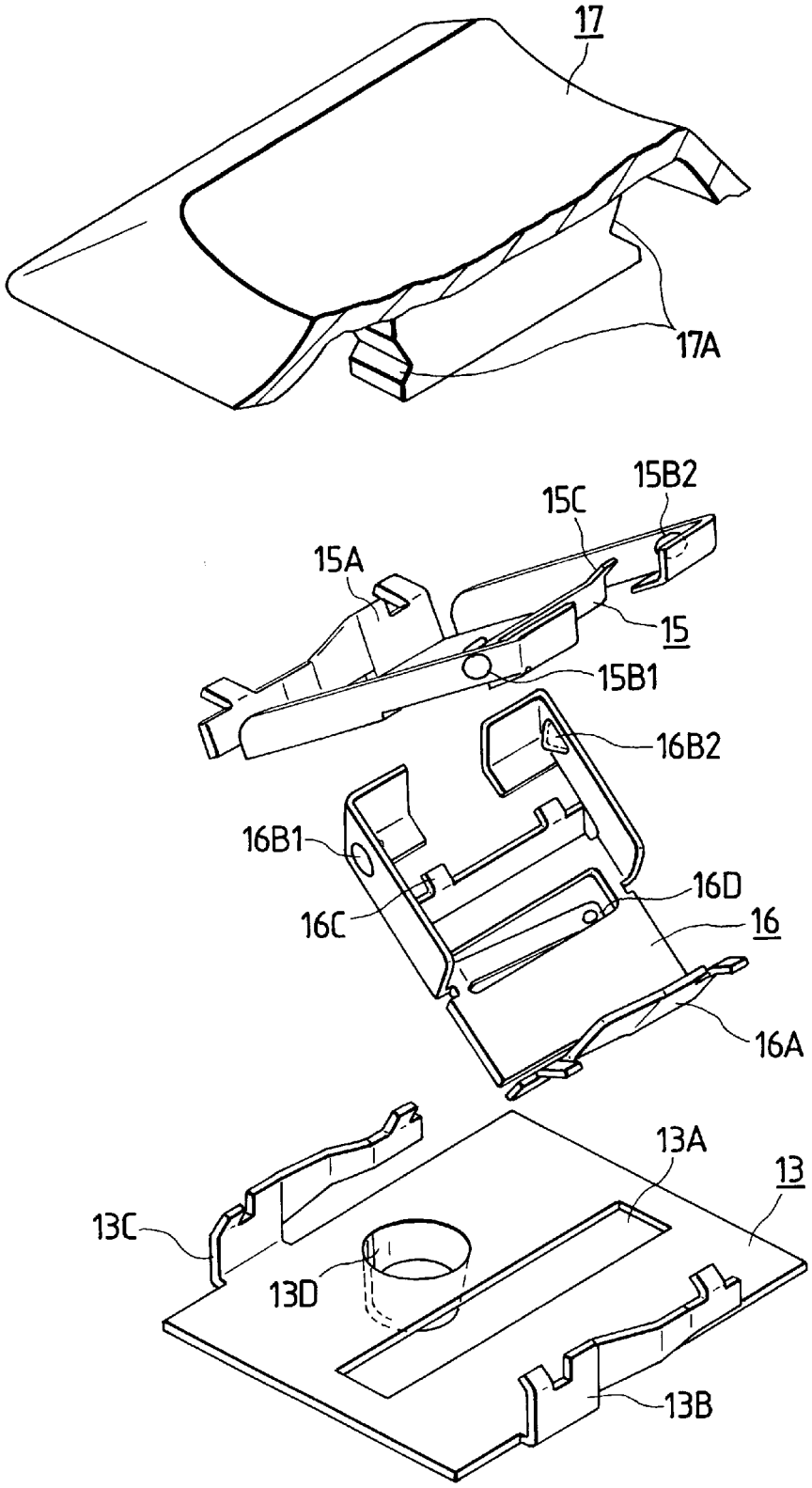
FIG. 2 is a perspective exploded view showing the push button switch shown in FIG. 1.
Figure 3:
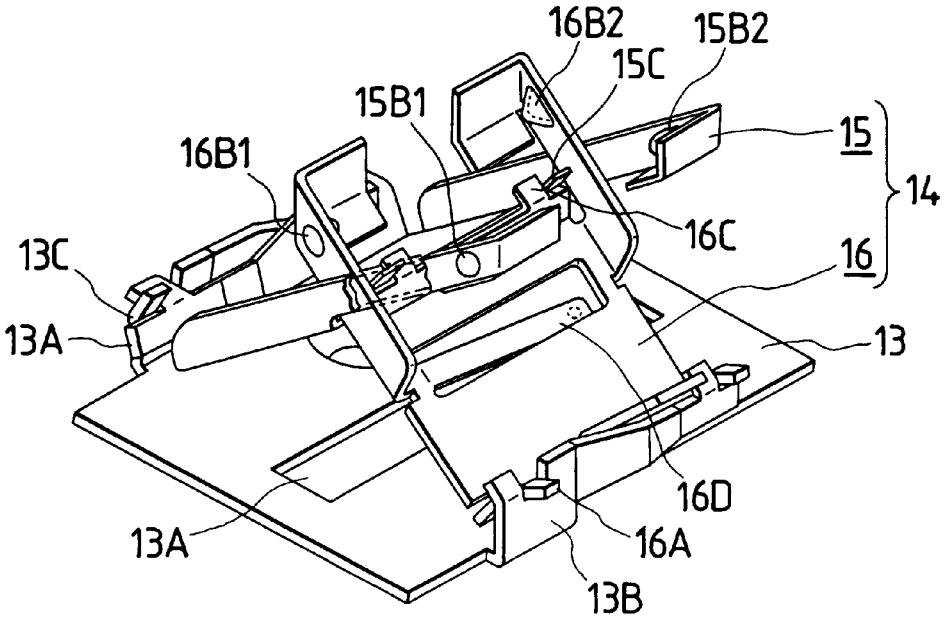
FIG. 3 is a perspective view showing a link member assembled with a base member.
Figure 4:
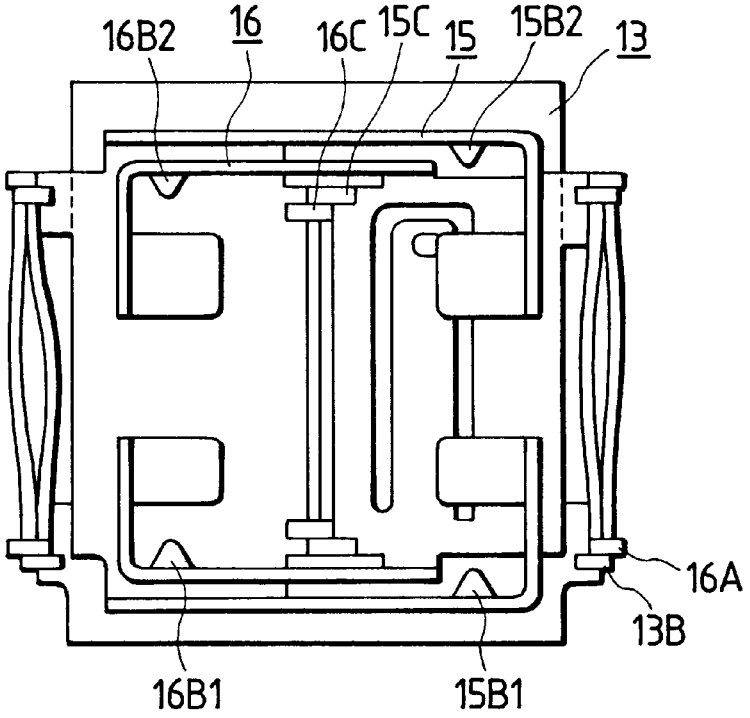
FIG. 4 is a plan view showing the link member and the base member of FIG. 3.

FIG. 1 is a cross-sectional view showing a push button switch in accordance with a first embodiment of the present invention. FIG. 2 is a perspective exploded view showing the push button switch shown in FIG. 1. FIG. 3 is a perspective view showing a link member assembled with a base member. FIG. 4 is a plan view showing the link member and the base member of FIG. 3.

In the drawings, reference numeral 11 denotes a base plate made of a rigid material such as a metal plate. Reference numeral 12 denotes a switch member comprising two films printed with a conductive paste. One film is put on the other film to constitute opposed switch contacts. Reference numeral 13 denotes a base member made of an elastic metal plate. The base member 13 is disposed on the switch member 12. The base member 13 has an opening 13A positioned on the opposed switch contacts of the switch member 12. A projecting piece 13D, fabricated by burring, is provided at the lower surface of the base plate 13. The projecting piece 13D is inserted into a through hole 12A opened thoroughly across the switch member 12 and a fixing hole 11A opened thoroughly across the base plate 11. The lower end of the projecting piece 13D is fixed to the reverse surface of the base plate 11 by caulking As shown in FIGS. 1 and 3, reference numeral 14 denotes a link member consisting of two frame bodies 15 and 16 each being an elastic metal plate. Two frame bodies 15 and 16 are assembled in an X shape when seen from the side. Paired engaging portions 15C and 16C are provided at central portions of the frame bodies 15 and 16 for assembling one frame body 15 rotatably with the other frame body 16. The link member 14 is placed on the base member 11. A pair of projecting support portions 13B and 13C are provided on the upper surface of the base member 13. The frame bodies 16 and 15 have lower end portions 16A and 15A hinged by the projecting support portions 13B and 13C.

Each of the support portions 13B and 13C of the base member 13 and the lower end portions 16A and 15A of two frame bodies 16 and 15 is configured into a cantilever spring resiliently deformable along a horizontal plane. A distal end of one cantilever spring is engaged with a proximal end of the combined cantilever spring.

Furthermore, reference numeral 17 denotes a key top member. Recessed engaging portions 17A, each having a recessed groove facing outward, are provided at a central portion of a lower surface of the key top member 17. Projections 15B1 and 15B2 are provided on opposing inner faces of upper end portions of the frame body 15. Projections 16B1 and 16B2 are provided on opposing inner faces of upper end portions of the other frame body 16. These projections 15B1, 15B2, 16B1 and 16B2, serving as engaging means for engaging the frame bodies 15 and 16 with the key top member 17, elastically clamp the recessed engaging groove 17A of the key top member 17. Each of the projections 15B1, 15B2, 16B1 and 16B2 is rotatable and slidable along the recessed engaging groove 17A.

A contact pushing portion 16D of an elastic cantilever spring, for pushing the opposed switch contacts, is provided on at least one of two frame bodies 15 and 16 cooperatively constituting the link member 14.

Figure 5:
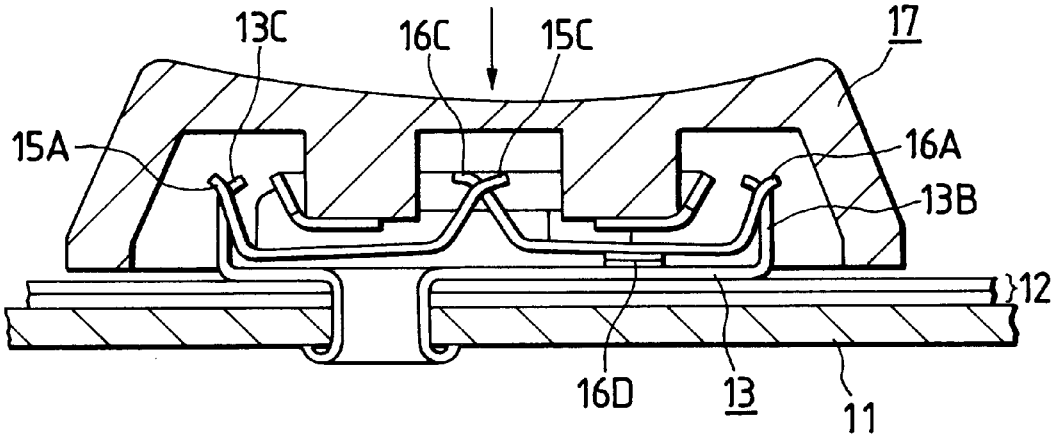
FIG. 5 is a cross-sectional view showing a key top member in a depressed condition.

Next, operation of the above-described push button switch in accordance with this embodiment will be explained with reference to FIG. 5.

First, when the key top member 17 is depressed downward by a finger placed on the upper surface of the key top member 17, the link member 14 causes a swing motion about a crossing portion of the paired engaging portions 15C and 16C. The cantilever spring portions formed at the support portions 13B and 13C of the base member 13 and the lower end portions 16A and 15A of the link member 14 are resiliently deformed. The contact pushing portion 16D provided on the link member 14 pushes the opposed switch contacts of the switch member 12 to generates a predetermined turning-on signal.

When the key top member 17 is depressed downward, the paired engaging portions 15C and 16C of two frame bodies rotatably assembled in the X shape when seen from the side are lowered to an altitudinal level equivalent to a plane comprising two support portions 13B and 13C of the base member 13 provided for rotatably supporting the lower end portions 16A and 15A of the frame bodies 15 and 16 of the link member 14. The link member 14 or the base member 13 is made of an elastic material resiliently deformable in response to a down stroke of the key top member 17. The increased deformation stress of the link member 14 or the base member 13 is substantially reduced to zero when the paired engaging portions 15C and 16C of two frame bodies reach the above-described plane. This brings an appropriate click feeling during the depressing operation of the key top member 17.

Thereafter, the key top member 17 is released from a depressing force applied thereon. Upon releasing the depressing force, the contact pushing portion 16D is pushed backward by the opposed switch contacts of the switch member 12. The link member 14 is pushed backward by the resilient force of the contact pushing portion 16D. Then, the link member 14 returns to the original condition shown in FIG. 1 by the resilient force given from the cantilever spring portions formed at the support portions 13B and 13C of the base member 13 and the lower end portions 16A and 15A of the link member 14.

An operation load or a restoring force of the key top member 17, as well as its operation stroke during the turning-on operation of the switch, can be adequately determined according to the used material, thickness of the material, bending size etc., when the link member 14 or the base member 13 is fabricated by a press working of an elastic metal plate, such as a stainless steel plate or a phosphor bronze plate.

The above-described embodiment is based on the arrangement that the cantilever spring portions are provided at the lower end portions 16A and 15A of two frame bodies 16 and 15 of the link member 14 and the support portions 13B and 13C of the base member 13. However, the present invention is not limited to the above-described embodiment. For example, substantially the same effects will be obtained even when either the lower end portions 16A and 15A or the support portions 13B and 13C are resiliently deformable along the horizontal plane. It is further preferable that at least one of the support portions 13B and 13C of the base member 13 supporting the link member 14 can be configured into a cantilever spring. Similarly, it is preferable that at least one of the lower end portions 16A and 15A of two frame bodies 16 and 15 of the link member 14 supported by the base member 13 can be configured into a cantilever spring.

Figure 6:
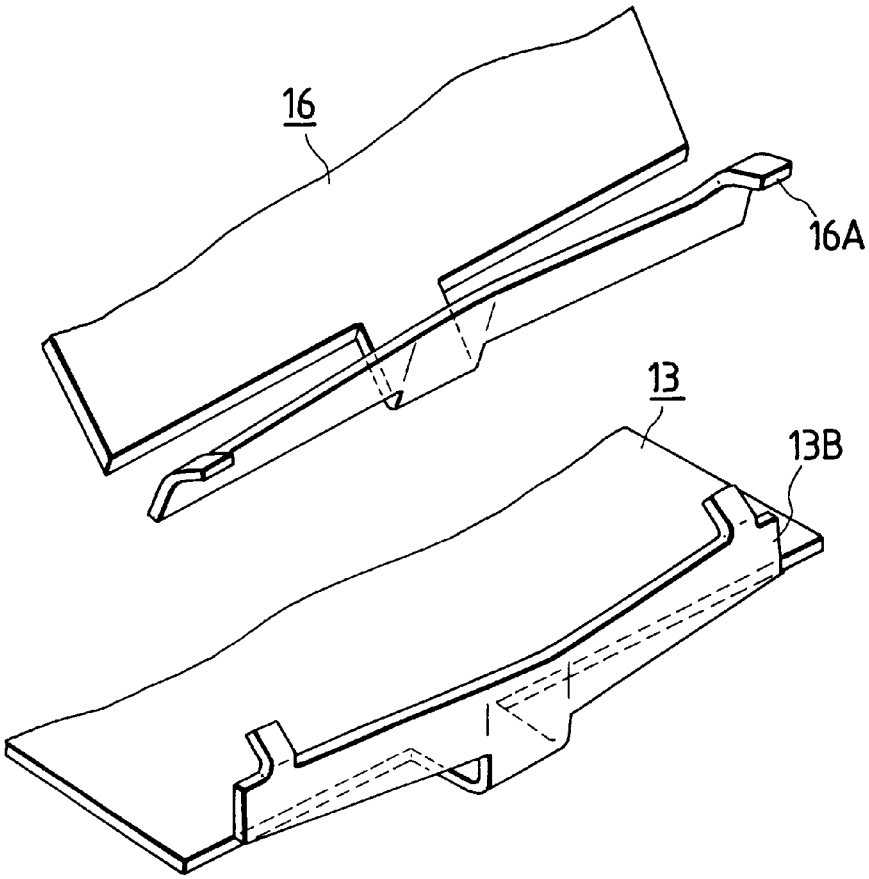
FIG. 6 is a perspective exploded view showing other example of a cantilever spring used for the link member or the base member.

Regarding the cantilever spring, substantially the same effects can be obtained even when it is modified into a shape shown in FIG. 6. The cantilever spring shown in FIG. 6 has two elastic bars, each serving as a cantilever spring, extending horizontally in opposite directions and supported by a vertical bar provided at a central portion. Furthermore, according to the above-described embodiment, the key top member 17 has the recessed engaging portions 17A facing outward and clamped by the elastic protrusions 15B1, 15B2, 16B1 and 16B2 of the link member 14.

Figure 7:
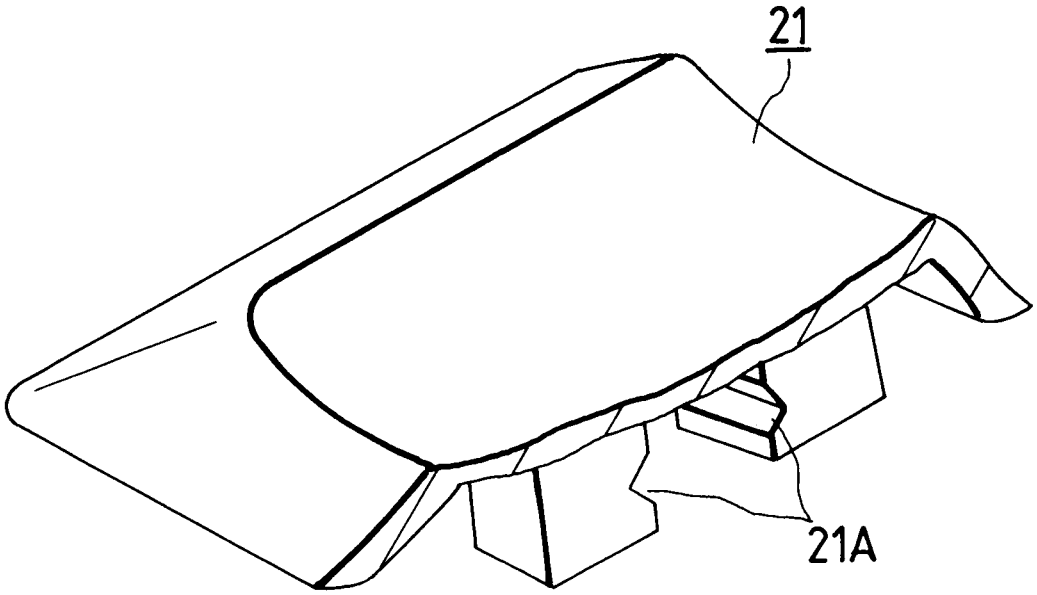
FIG. 7 is a partly cross-sectional perspective exploded view showing other structure for assembling a key top member on a link member.
Figure 7:
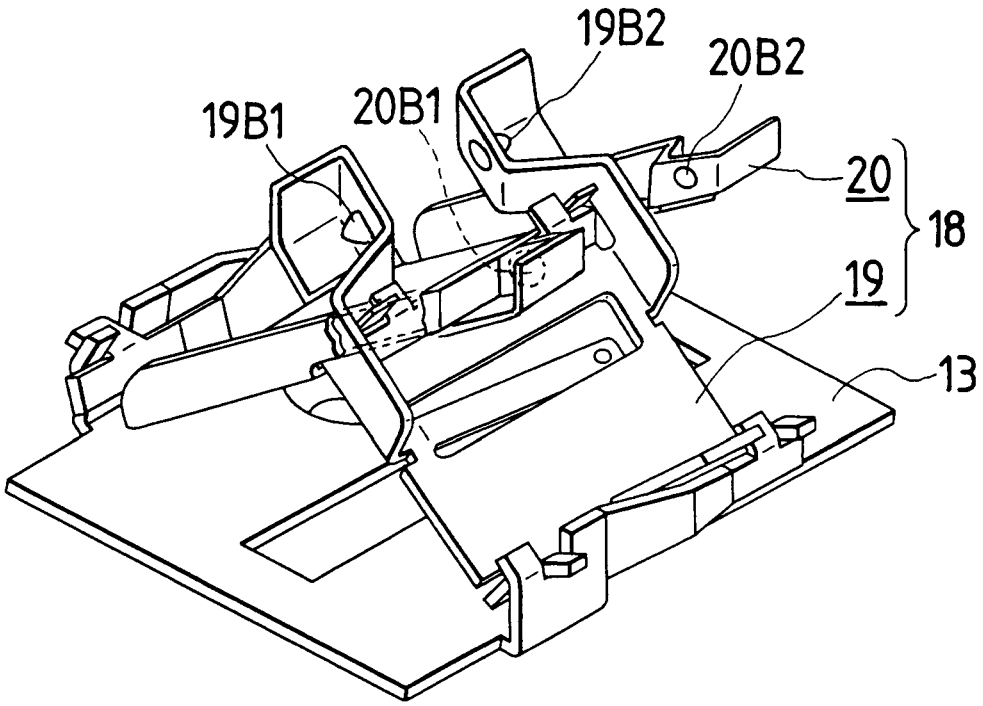

Moreover, as shown in FIG. 7, it is possible to provide projections 19B1 and 19B2 on outer sides of the opposing faces of the upper end portions of one frame body 19. Projections 20B1 and 20B2 are provided on outer sides of the opposing faces of the upper end portions of the other frame body 20. These projections 19B1, 19B2, 20B1 and 20B2 serve as engaging means for engaging the frame bodies 19 and 20 cooperatively constituting a link member 18 with a key top member 21. Recessed engaging portions 21A, each having a recess groove facing inward, are provided at a central portion of a lower surface of the key top member 21. The projections 19B1, 19B2, 20B1 and 20B2 of the link member 18 are resiliently engaged with the recessed engaging groove 21A of the key top member 21.

Furthermore, the above-described embodiment uses the elastic contact pushing portion 16D of a cantilever spring as a means for pushing the opposed switch contacts. However, the means for pushing the opposed switch contacts is not limited to the disclosed one. Substantially the same effects can be obtained even when the elastic contact pushing portion 16D is replaced by any other comparable elastic member.

Figure 8:
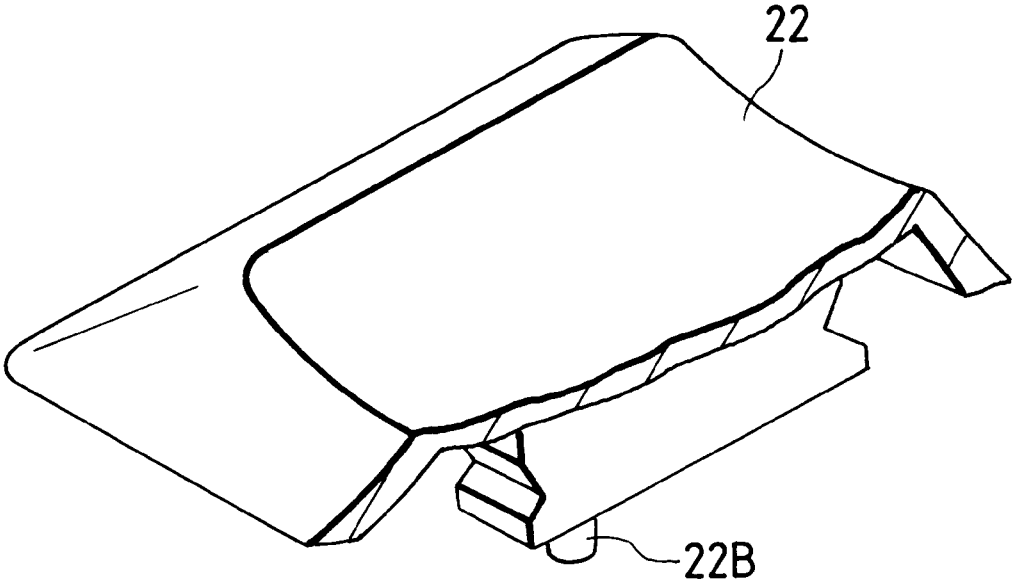
FIG. 8 is a partly cross-sectional perspective exploded view showing other example of a pushing member for opposed switch contacts.
Figure 8:
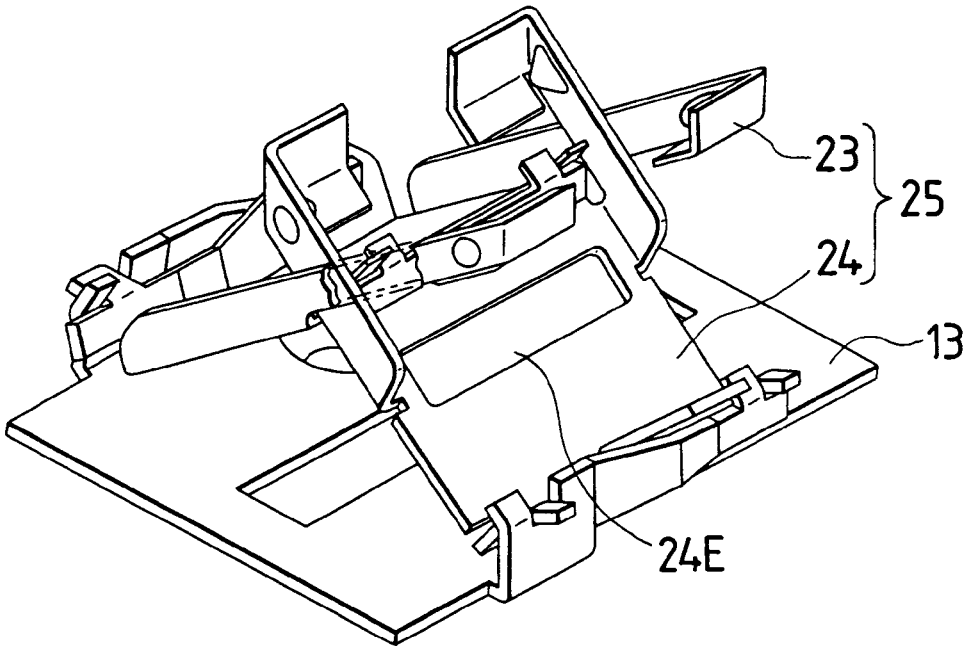

As shown in FIG. 8, a contact pushing portion 22B can be provided on a lower surface of a key top member 22 for pushing the opposed switch contacts of the switch member 12. An opening 24E, allowing the contact pushing portion 22B to pass through, is provided at least at one of two frame bodies 23 and 24 cooperatively constituting a link member 25. Thus, the contact pushing portion 22B pushes the opposed switch contacts of the switch member 12 at the lowest point of a depressing stroke of the key top member 22.

As described in the foregoing description, the first embodiment provides a push button switch comprising a key top member (17; 21; 22) having an engaging portion (17A; 21A) at a lower surface thereof; a link member (14; 18; 25) including a pair of frame bodies (15, 16; 19, 20; 23, 24) assembled in an X shape when seen from its side face, each frame body being swingable and having an upper end provided with an engaging means (15B1, 15B2, 16B1, 16B2; 19B1, 19B2, 20B1, 20B2) engageable with the engaging portion of said key top member; a base member (13) supporting a lower end portion (15A, 16A) of each frame body of the link member so that each frame body is rotatably hinged by the base member; opposed switch members (12) located underneath the base member for cooperatively generating a turning-on signal in response to a predetermined pushing force applied thereon; and at least one of the link member and the base member being an elastic member, wherein the elastic member is resiliently deformed in response to a depressing force applied on the key top member so as to allow part of either the link member or the key top member to push the opposed switch members, and the elastic member springs back to an original position upon releasing the depressing force applied on the key top member.

When the key top member is depressed, paired engaging portions (15C, 16C) formed on the frame bodies assembled in the X shaped are lowered to an altitudinal level equivalent to a plane comprising two support portions (13B, 13C) of the base member provided for hingedly supporting the lower end portions of the frame bodies of the link member. At least one of the link member and the base member is an elastic metal plate. A resiliently deformable portion is provided adjacent to at least one of two support portions of the base member supporting the link member, or provided adjacent to at least one of the two lower end portions of the frame bodies of the link member supported by the base member, wherein the resiliently deformable portion is deformed along a horizontal plane. At least one of the two support portions of the base member supporting the link member is configured into a cantilever spring. At least one of the lower end portions of the frame bodies of the link member supported by the base member is configured into a cantilever spring. The lower end portions (16A, 15A) of the frame bodies of the link member and the two support portions (13B, 13C) of the base member are engaged at two portions, at least one of the two portions is constituted by a combination of the lower end portion and the support portion configured into cantilever springs, and a distal end of one cantilever spring is engaged with a proximal end of the other cantilever spring.

Furthermore, protrusions (15B1, 15B2, 16B1, 16B2; 19B1, 19B2, 20B1, 20B2) are formed at opposing inner side faces or at outer side faces of a top end portion of each of the frame bodies (15, 16; 19, 20) constituting the link member, and the key top member (17; 21) has recessed portions (17A; 21A) formed at a lower surface thereof, the recessed portions mutually facing inward or outward directions so as to be resiliently clamped by the protrusions of the two frame bodies and allowing the protrusions to rotate and slide. A contact pushing portion (22B) is formed on a lower surface of the key top member (22) so that the opposed switch members (12) are pushed by the contact pushing portion. A contact pushing portion (16D) is formed on at least one of two frame bodies (15, 16) constituting the link member (14), so that the opposed switch members (12) are pushed by the contact pushing portion. The contact pushing portion (16D) is a resiliently deformable cantilever spring. A projecting piece (13D) is provided on a lower surface of the base member, and the projecting piece is inserted into a fixing hole (11A) opened thoroughly across a rigid base plate (11) so as to sandwich the opposed switch members (12) between the base member (13) and the base plate (11).

Second Embodiment

Figure 9:
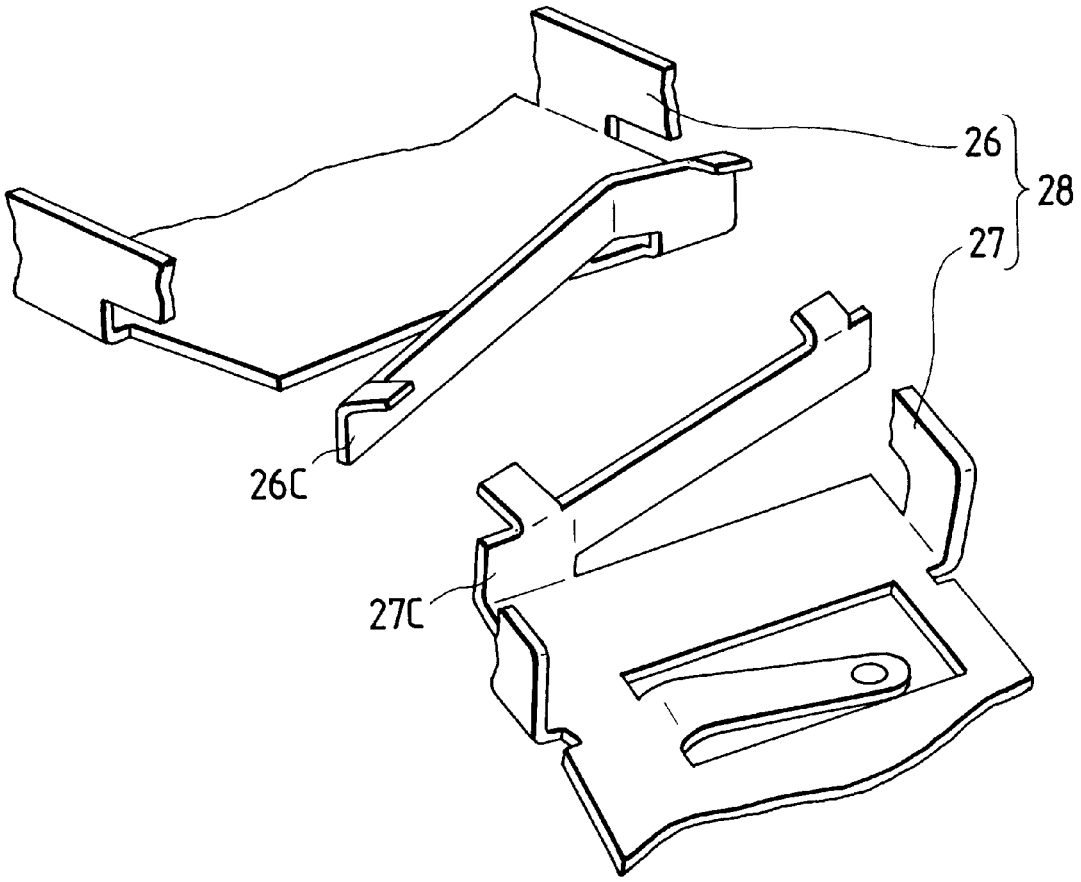
FIG. 9 is a perspective exploded view showing an essential arrangement of a link member of a push button switch in accordance with a second embodiment of the present invention.

FIG. 9 is a perspective exploded view showing a link member of a push button switch in accordance with a second embodiment of the present invention. As shown in FIG. 9, a link member 28 includes two frame bodies 26 and 27 provided with paired engaging portions 26C and 27C each configured into a resilient cantilever spring. A distal end of one cantilever spring is engaged with a proximal end of the other cantilever spring. When the key top member 17 is depressed downward, the paired engaging portions 26C and 27C of two frame bodies 26 and 27 are resiliently deformed. In other words, the paired engaging portions 26C and 27C generate a sufficient elastic force for restoring both the link member 28 and the key top member 17 to their original positions.

Figure 10:
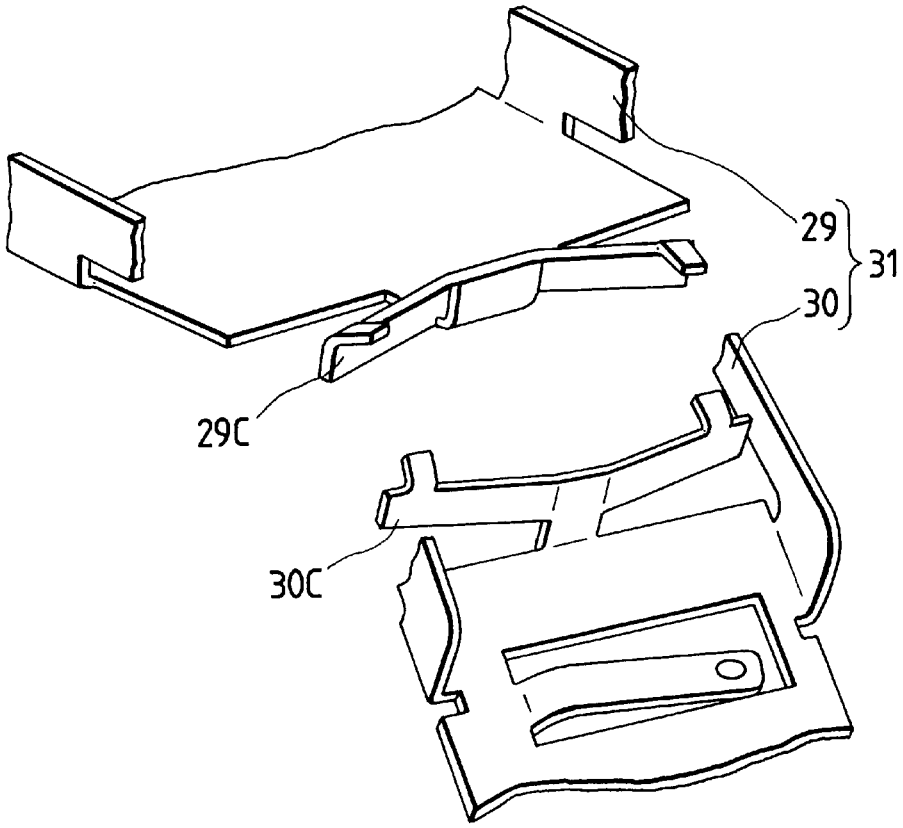
FIG. 10 is a perspective exploded view showing an essential arrangement of other example of a cantilever spring formed on the link member.

It is acceptable that the cantilever spring portion is provided at least at one of the paired engaging portions 26C and 27C of two frame bodies 26 and 27 constituting the link member 28. Furthermore, a push button switch capable of stably generating a similar elastic restoring force can be realized by providing a link member 31 comprising two frame bodies 29 and 30 shown in FIG. 10. The frame bodies 29 and 30 shown in FIG. 10 are provided with paired engaging portions 29C and 30C each having two cantilever elastic bars extending horizontally in opposite directions supported by a vertical bar provided at a central portion.

As described in the foregoing description, in addition to the fundamental arrangement disclosed in the first embodiment, the second embodiment provides a push button switch having resiliently deformable portions provided adjacent to paired engaging portions (26C, 27C; 29C, 30C) of the two frame bodies (26, 27; 29, 30) constituting the link member (28; 31). At least one of the paired engaging portions (26C, 27C, 29C, 30C) of the two frame bodies is configured into a cantilever spring. The paired engaging portions (26C, 27C) of the two frame bodies constituting the link member are configured into cantilever springs, and a distal end of one cantilever spring is engaged with a proximal end of the other cantilever spring.

Third Embodiment

Figure 11:
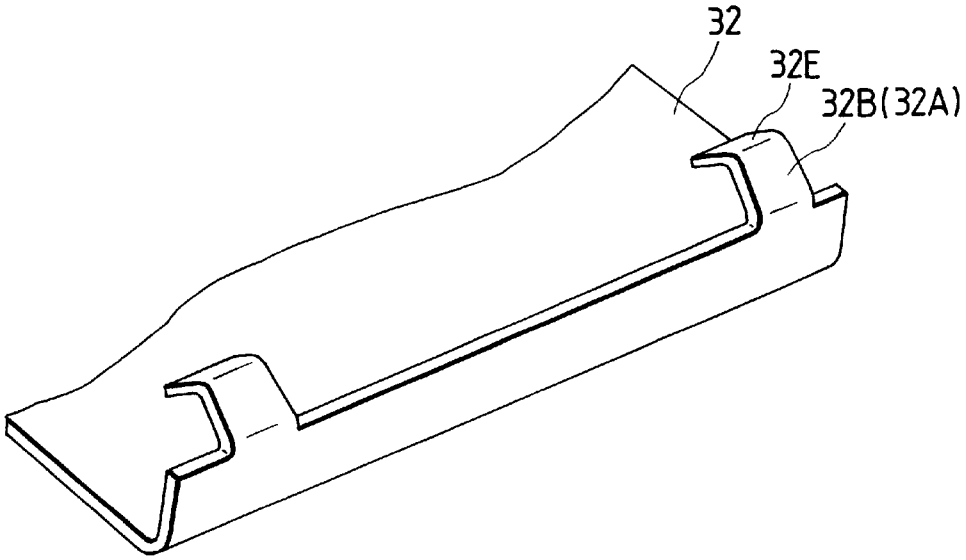
FIG. 11 is a perspective exploded view showing an essential arrangement of a base member of a push button switch in accordance with a third embodiment of the present invention.
Figure 12:
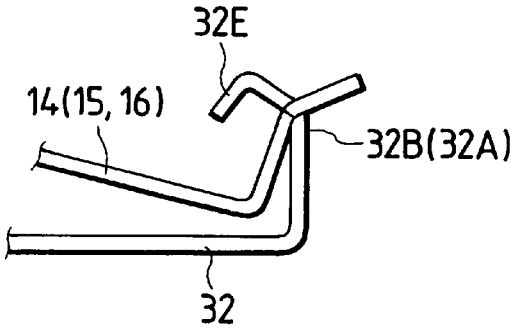
FIG. 12 is a side view showing an essential arrangement of a link member assembled with the base member shown in FIG. 11.

FIG. 11 is a perspective view showing an essential arrangement of a base member of a push button switch in accordance with a third embodiment of the present invention. FIG. 12 is a side view showing the link member assembled with a base member. As shown in FIGS. 11 and 12, a hook portion 32E is provided at each of two support portions 32B (32A) of a base member 32 supporting the link member 14. The hook portion 32E prevents the link member 14 from being disengaged from the support portions 32B (32A) of the base member 32. Accordingly, after the base member 32 is assembled with the link member 14, it becomes possible to prevent the link member 14 from being disengaged from the base member 32 in a succeeding assembling process or when the key top member 17 is installed on or detached from the link member 14.

As apparent from the foregoing description, in addition to the fundamental arrangement disclosed in the first embodiment, the third embodiment provides a push button switch comprising two support portions (32A, 32B) of the base member (32) supporting the link member (14) have a receiving portion with a hook portion (32E), and the hook portion prevents the link member from disengaging from the base member.

Fourth Embodiment

Figure 14A:
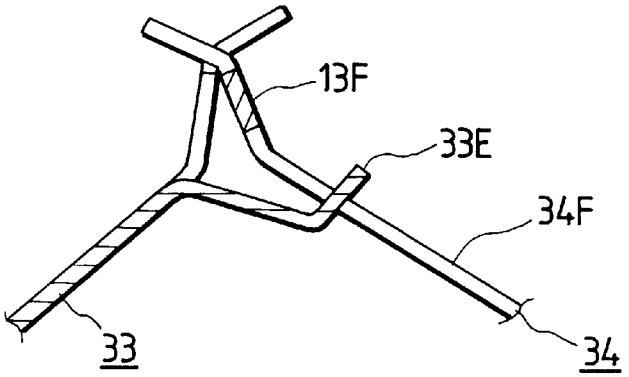
FIG. 14A is a cross-sectional side view showing an assembled condition of the link member shown in FIG. 13.
Figure 14B:
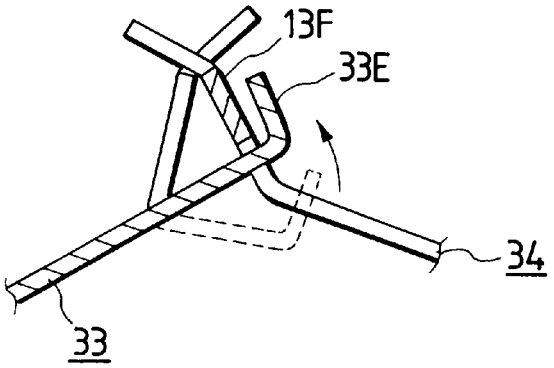
FIG. 14B is a cross-sectional side view showing a condition that a hook portion of the link member is bent.
Figure 13:
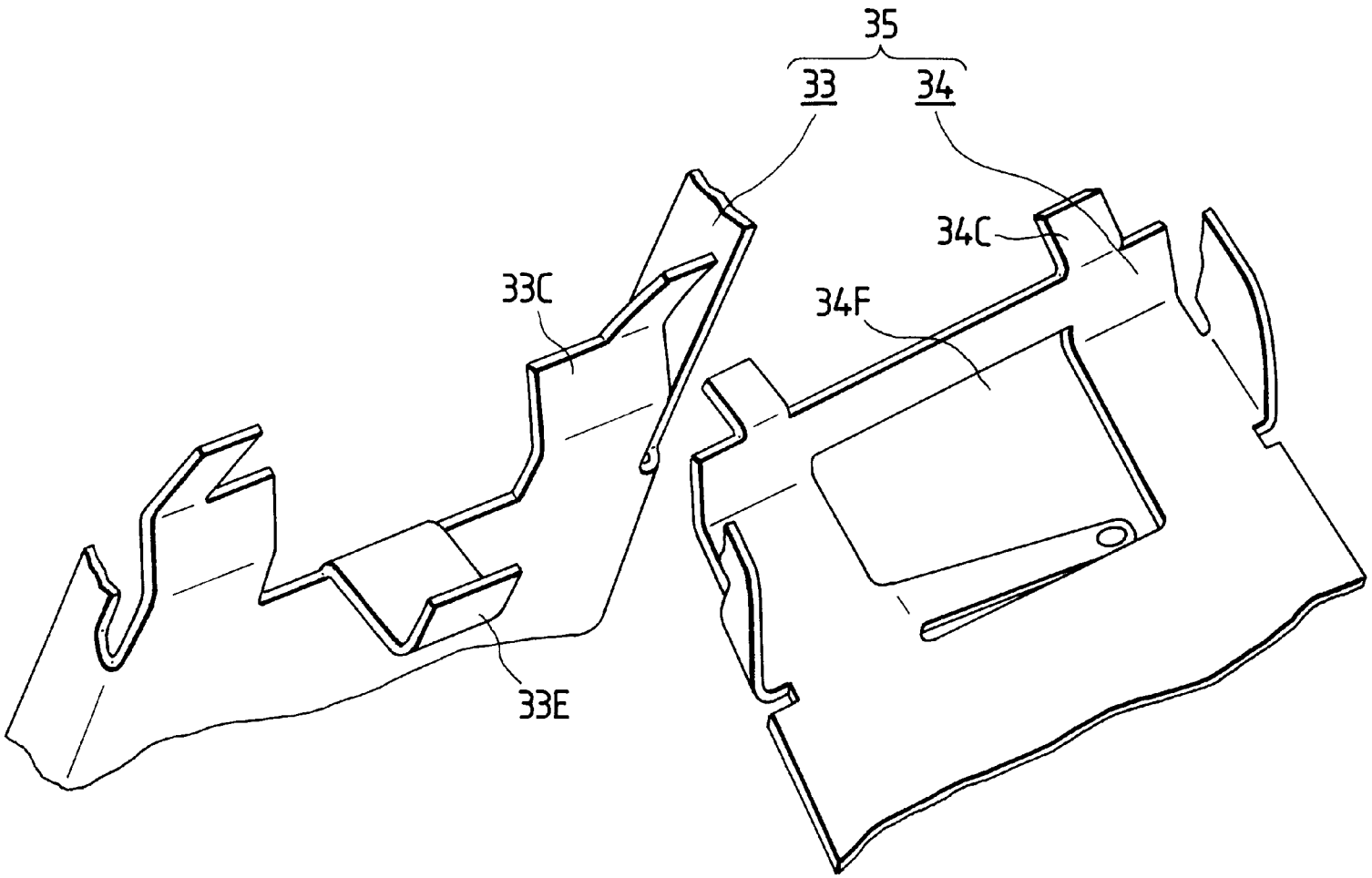
FIG. 13 is a perspective exploded view showing an essential arrangement of a link member of a push button switch in accordance with a fourth embodiment of the present invention.

FIG. 13 is a perspective exploded view showing an essential arrangement of a link member of a push button switch in accordance with a fourth embodiment of the present invention. FIGS. 14A and 14B are cross-sectional side views showing the link member in an assembled condition. As shown in FIGS. 13, 14A and 14B, a link member 35 comprises two frame bodies 33 and 34 provided with paired engaging portions 33C and 34C. An L-shaped hook portion 33E is provided on one of the paired engaging portions 33C and 34C. An engaging hole 34F is provided on the other of the paired engaging portions 33C and 34C. When these frame bodies 33 and 34 are assembled, the L-shaped hook portion 33E of one paired engaging portion 33C (or 34C) is inserted into the engaging hole 34F of the other paired engaging portion 34C (or 33C). Then, the L-shaped hook portion 33E is bent to ensure the engagement between the two frame bodies 33 and 34. With this arrangement, it becomes possible to prevent the link member 35 from being disengaged from the base member in an assembling process or when the key top member 17 is installed on or detached from the link member 35.

As apparent from the foregoing description, in addition to the fundamental arrangement disclosed in the first embodiment, the fourth embodiment provides a push button switch wherein one of the two frame bodies (33, 34) constituting the link member (35) has an L-shaped hook portion (33E) at paired engaging portions (33C, 34C) of the two frame bodies (33, 34), and the L-shaped hook portion is inserted into an engaging hole (34F) of the other frame body when the two frame bodies are assembled and the L-shaped hook is bent in a predetermined direction so as to ensure engagement between the two frame bodies.

Fifth Embodiment

FIGS. 15A through 15D are perspective views illustrating sequential assembling steps of a manufacturing method of push button switches in accordance with a fifth embodiment of the present invention.

Figure 15A:
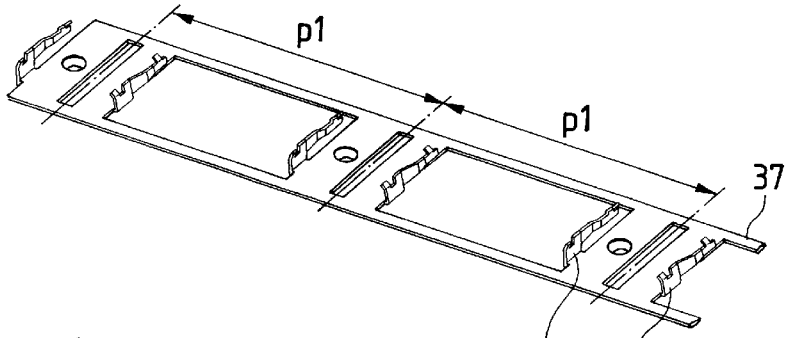
FIG. 15A is a perspective view showing a hooped elastic metal plate with base member portions formed thereon in accordance with a manufacturing method of push button switches in accordance with a fifth embodiment of the present invention.
Figure 15B:
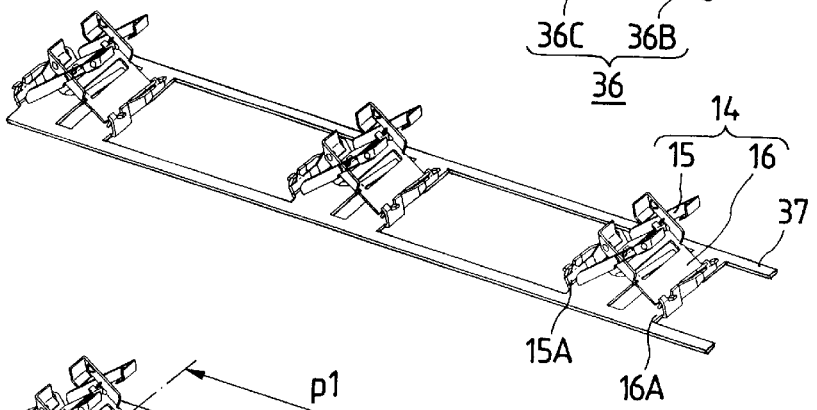
FIG. 15B is a perspective view showing an assembling step wherein link members are engaged with the base member portions formed on the hooped elastic metal plate.
Figure 15C:
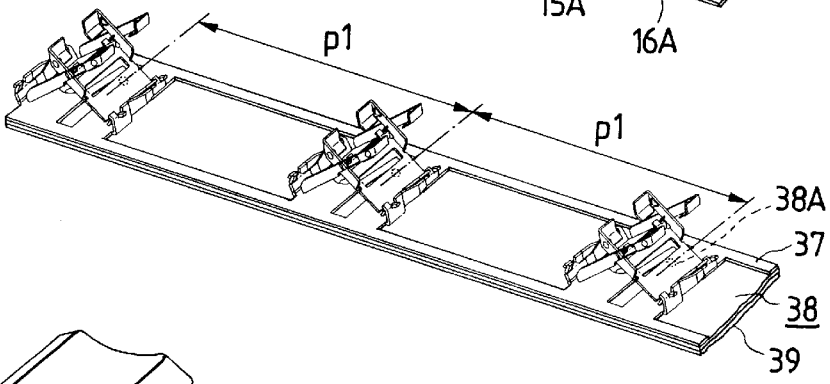
FIG. 15C is a perspective view showing an assembling step wherein the hooped elastic metal plate is assembled with a hooped switch member plate and a base plate.
Figure 15D:
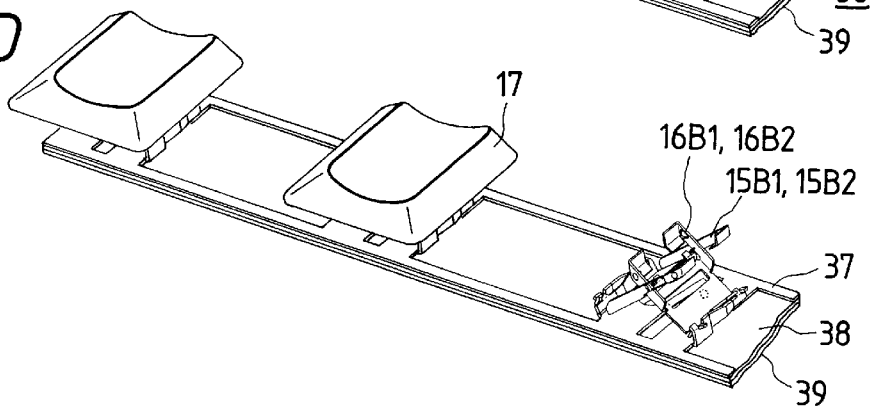
FIG. 15D is a perspective view showing an assembling step wherein key top members are engaged on link members.

FIG. 15A discloses a hooped elastic metal plate 37 on which a plurality of base member portions 36 are continuously formed at predetermined pitches p1, for example, corresponding to key layout of a keyboard used for a personal computer. Each base member portion 36 comprises a pair of support portions 36B and 36C. As shown in FIG. 15B, two frame bodies 16 and 15 of each link member 14 are assembled on the base member portion 36. The lower end portions 16A and 15A of the frame bodies 16 and 15 are hinged by the support portions 36B and 36C of the base member portion 36. Then, as shown in FIG. 15C, a hooped switch member plate 38 and a base plate 39 are assembled underneath the hooped metal plate 37. A plurality of opposed switch portions 38A are continuously formed on the hooped switch member plate 38 at the same pitches p1 as the base member portions 36 formed on the hooped elastic metal plate 37. A plurality of fixing holes (not shown) are formed at corresponding pitches on the base plate 39. Thus, the hooped switch member plate 38 and the base plate 39 are assembled underneath the hooped metal plate 37 so as to adjust their mutual positional relationship. Finally, as shown in FIG. 15D, the key top member 17 is mounted on the frame bodies 15 and 16 of a corresponding link member 14 and resiliently clamped by the protrusions 15B1, 15B2, 16B1 and 16B2 formed at the upper end portions of these frame bodies 15 and 16.

As apparent from the foregoing description, the fifth embodiment provides a manufacturing method of push button switches comprising the steps of: forming a plurality of base member portions (36) continuously at predetermined pitches (p1) on a hooped elastic metal plate (37); mounting each link member (14) on a corresponding base member portion (36) on the hooped elastic metal plate by engaging lower end portions (16A, 15A) of the link member with support portions (36B, 36C) of a corresponding base member portion so that the link member is rotatably hinged about the support portions; assembling a hooped switch member plate (38), having a plurality of opposed switch portions (38A) formed thereon at the same pitches (p1) as the base member portions, underneath the hooped elastic metal plate so as to adjust a mutual relationship between the base member portions and the opposed switch portions; and placing a key top member (17) on each link member, thereby obtaining a plurality of push button switches connected in a hooped condition.

According to the above-described manufacturing method, a plurality of push button switches connected in a hooped condition are assembled at a time. An automated assembling for the push button switches can be easily realized.

The manufacturing method of the push button switch of this embodiment is not limited to the above-described one. For example, substantially the same effects will be obtained when the push button switches are assembled by using a manufacturing method shown in FIGS. 16A to 16E. According to the manufacturing method shown in FIGS. 16A–16E, the layout pitches are determined to be efficient values for a press working of the base member portions formed on the hooped elastic metal plate.

Figure 16A:
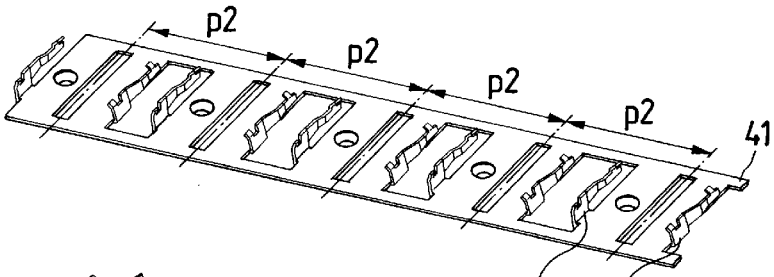
FIG. 16A is a perspective view showing a hooped elastic metal plate with base member portions formed thereon in accordance with another manufacturing method of push button switches in accordance with the fifth embodiment of the present invention.
Figure 16B:
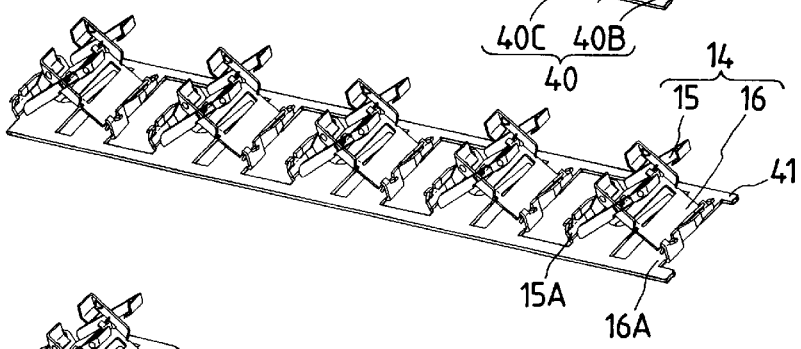
FIG. 16B is a perspective view showing an assembling step wherein link members are engaged with the base member portions formed on the hooped elastic metal plate.
Figure 16C:
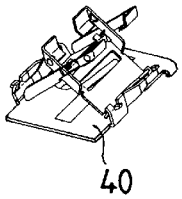
FIG. 16C is a perspective view showing a separating step wherein individual base members are separated from the hooped elastic metal plate.
Figure 16D:
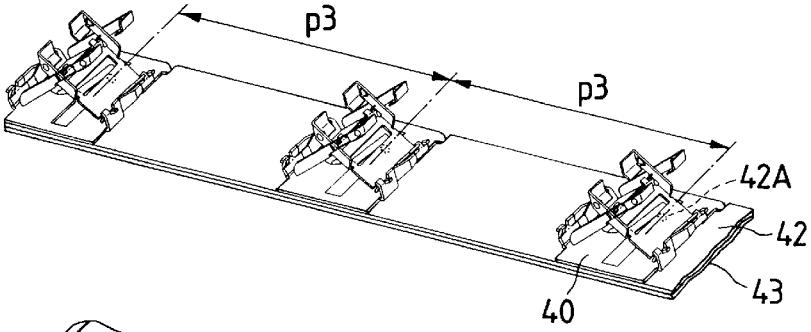
FIG. 16D is a perspective view showing an assembling step wherein the separated base members are rearranged on a hooped switch member plate and a base plate.
Figure 16E:
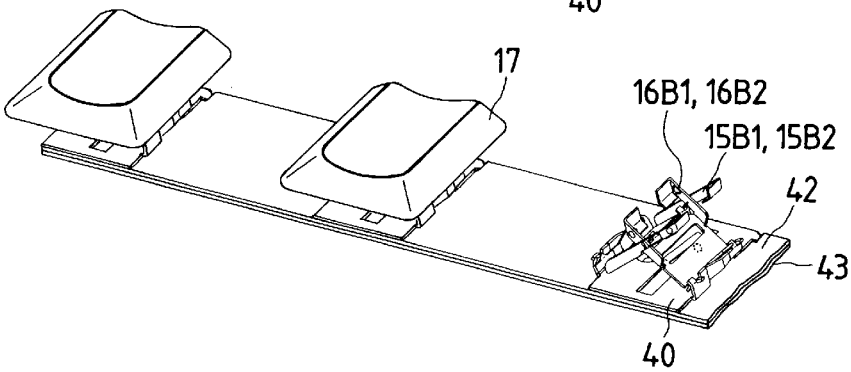
FIG. 16E is a perspective view showing an assembling step wherein key top members are engaged on link members.
Figure 17:
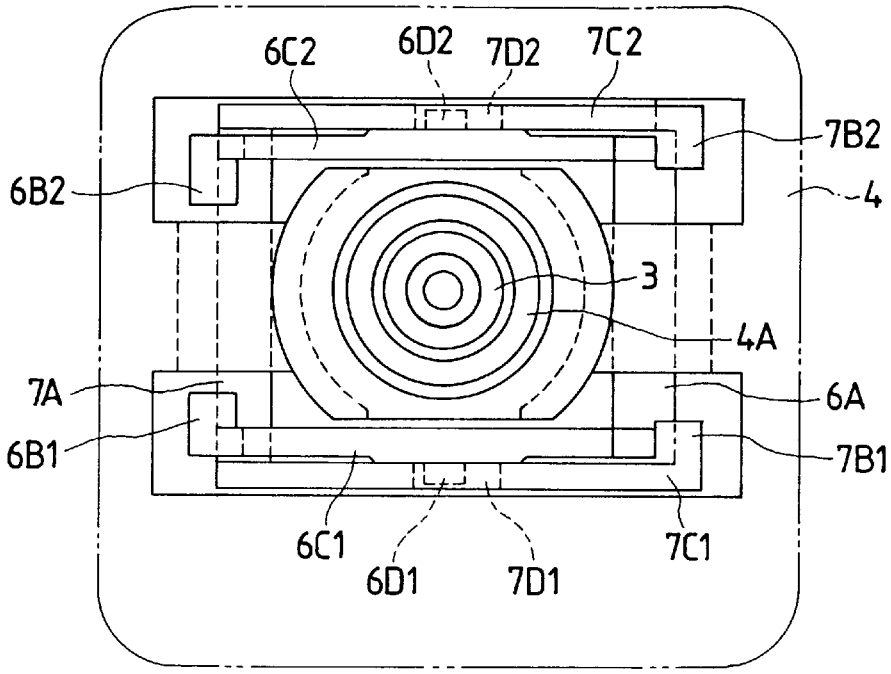
FIG. 17 PRIOR ART
FIG. 17 is a plan view showing a conventional push button switch.
Figure 18:
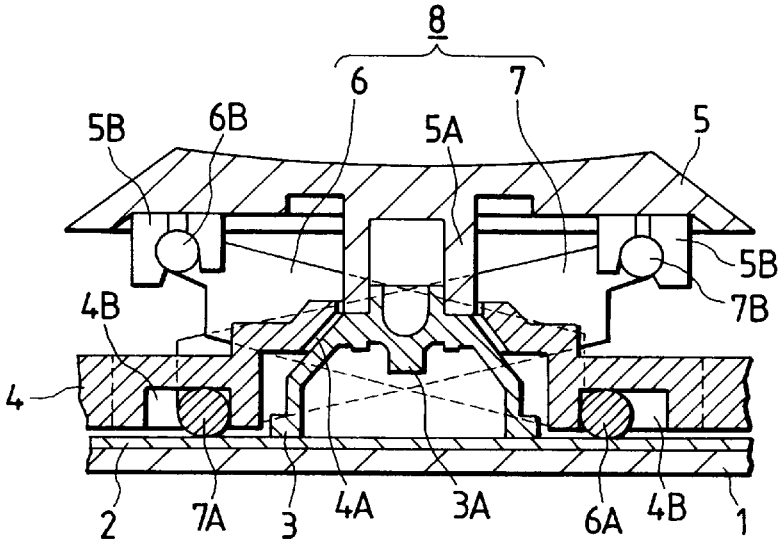
FIG. 18 PRIOR ART
FIG. 18 is a cross-sectional view showing the conventional push button switch shown in FIG. 17.
Figure 19:
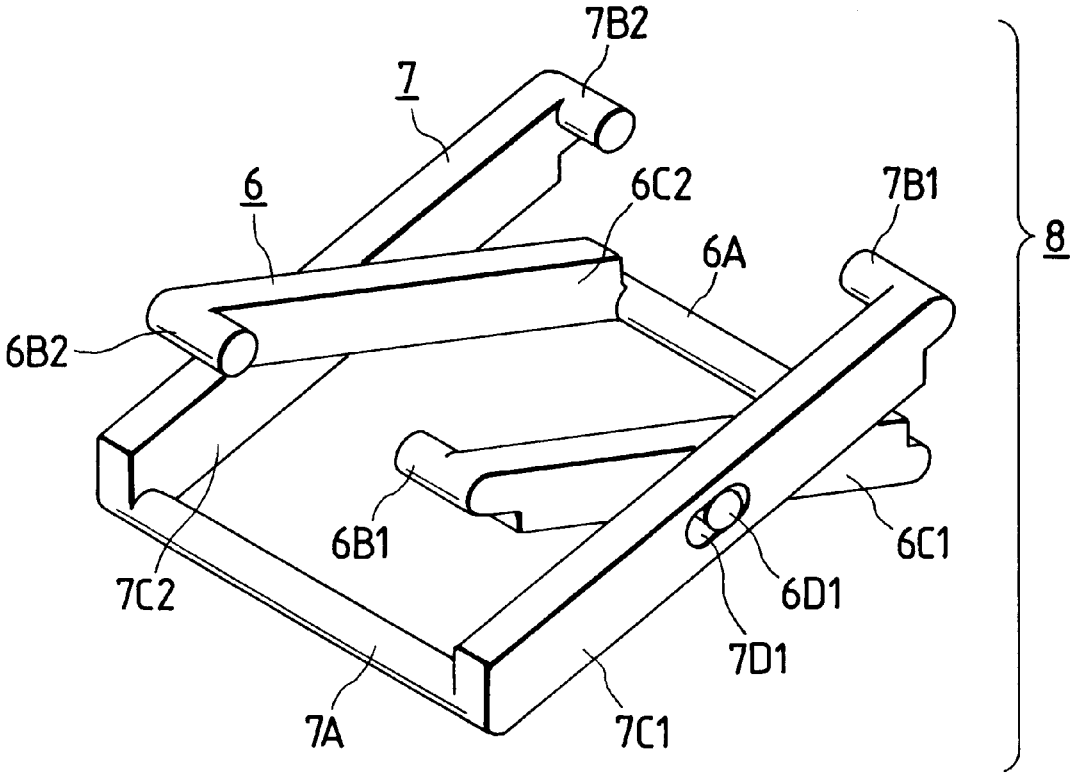
FIG. 19 PRIOR ART
FIG. 19 is a perspective view showing an assembled condition of a link member used in the conventional push button switch shown in FIG. 17.
Figure 20:
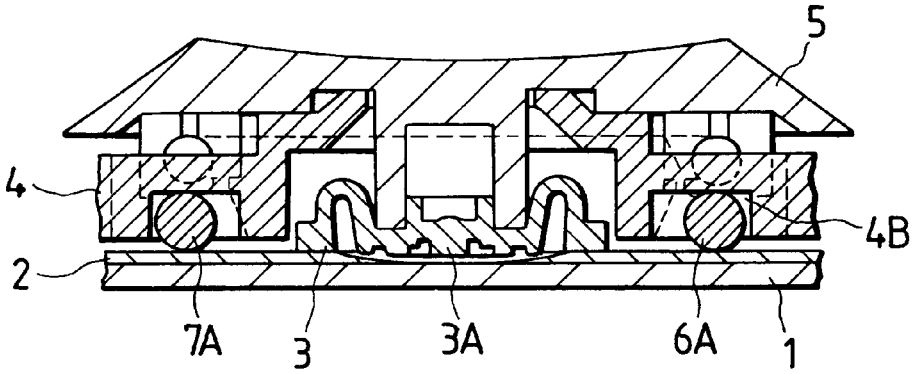
FIG. 20 PRIOR ART
FIG. 20 is a cross-sectional view showing an operational condition of the conventional push button switch shown in FIG. 17.

FIG. 16A shows a hooped elastic metal plate 41 on which a plurality of base member portions 40 are continuously formed at predetermined pitches p2, for example, corresponding to the required minimum pitches. Each base member portion 40 comprises a pair of support portions 40B and 40C. As shown in FIG. 16B, two frame bodies 16 and 15 of each link member 14 are assembled on a corresponding base member portion 40 of the hooped elastic metal plate 41. The lower end portions 16A and 15A of the frame bodies 16 and 15 are hinged by the support portions 40B and 40C of the base member portion 40. Then, as shown in FIG. 16C, individual base members 40 each mounting a corresponding link member 14 are separated from the hooped elastic metal plate 41. Next, as shown in FIG. 16D, the separated base members 40 are positioned or rearranged continuously at different pitches on a hooped switch member plate 42 laminated with a base plate 43. More specifically, the separated base members 40 are positioned (i.e., rearranged) at the same pitches p3 as opposed switch portions 42A continuously formed on the hooped switch member plate 42. For example, the pitches p3 correspond to key layout of a keyboard used for a personal computer. A plurality of fixing holes (not shown) are formed at the corresponding pitches on the base plate 43. Finally, as shown in FIG. 16E, the key top member 17 is mounted on the frame bodies 15 and 16 of a corresponding link member 14 and resiliently clamped by the protrusions 15B1, 15B2, 16B1 and 16B2 formed at the upper end portions of these frame bodies 15 and 16.

As apparent from the foregoing description, the fifth embodiment provides another manufacturing method of push button switches comprising the steps of: forming a plurality of base member portions (40) continuously at predetermined pitches (p2) on a hooped elastic metal plate (41); mounting each link member (14) on a corresponding base member portion (40) on the hooped elastic metal plate by engaging lower end portions (16A, 15A) of the link member with support portions (40B, 40C) of a corresponding base member portion so that the link member is rotatably hinged about the support portions; separating individual base members (40) from the hooped elastic metal plate (41); positioning the separated base members on a hooped switch member plate (42) so as to correspond to a plurality of opposed switch portions (42A) formed thereon at predetermined pitches (p3) larger than the pitches (p2) of the continuous base member portions (40) formed on the hooped elastic plate (41); and placing a key top member (17) on each link member, thereby obtaining a plurality of push button switches connected in a hooped condition.

According to the above-described manufacturing method, a plurality of push button switches connected in a hooped condition are assembled at a time. Furthermore, this manufacturing method is applicable to any kind of push button switches by adjusting the layout pitches between the switch components and the base plate.

As apparent from the foregoing description, the present invention provides a push button switch comprising a link member consisting of a set of frame bodies assembled in an X shape when seen from the side so as to be swingable each other. A base member is provided to support the link member. At least one of the link member and the base member is an elastic member which is interposed between a key top member and the opposed switch contacts. A spring-back force is obtained by the elastic member to restore the key top member and the link member to their original positions. Thus, the present invention makes it possible to reduce the number of resin components, and provide a push button switch reasonable in cost and low or short in size.

This invention may be embodied in several forms without departing from the spirit of essential characteristics thereof. The present embodiments as described are therefore intended to be only illustrative and not restrictive, since the scope of the invention is defined by the appended claims rather than by the description preceding them. All changes that fall within the metes and bounds of the claims, or equivalents of such metes and bounds, are therefore intended to be embraced by the claims.

What is claimed is:

1. A push button switch comprising:

a key top member having an engaging portion at a lower surface thereof;

a link member including a pair of frame bodies assembled in an X shape when seen from its side face, each frame body being swingable and having an upper end provided with an engaging means engageable with said engaging portion of said key top member;

a base member supporting a lower end portion of each of the frame bodies of said link member so that each of the frame bodies is rotatably hinged by the base member;

opposed switch members located underneath said base member for cooperatively generating a turning-on signal in response to a predetermined pushing force applied thereon; and at least one of said link member and said base member being an elastic member, wherein said elastic member is resiliently deformed in response to a depressing force applied on said key top member so as to allow part of either said link member or said key top member to push said opposed switch members, and said elastic member springs back to an original position upon releasing said depressing force applied on said key top member.

2. The push button switch in accordance with claim 1, wherein, when said key top member is depressed, paired engaging portions formed on said frame bodies assembled in the X shape are lowered to an altitudinal level equivalent to a plane comprising two support portions of said base member provided for hingedly supporting the lower end portions of the frame bodies of said link member.

3. The push button switch in accordance with claim 1, wherein at least one of said link member and said base member is an elastic metal plate.

4. The push button switch in accordance with claim 1, wherein a resiliently deformable portion is provided adjacent to at least one of two support portions of said base member supporting said link member, and said resiliently deformable portion is deformed along a horizontal plane.

5. The push button switch in accordance with claim 4, wherein at least one of said two support portions of said base member supporting said link member is configured into a cantilever spring.

6. The push button switch in accordance with claim 4, wherein at least one of said lower end portions of said frame bodies of said link member supported by said base member is configured into a cantilever spring.

7. The push button switch in accordance with claim 4, wherein said lower end portions of the frame bodies of the link member and said two support portions of said base member are engaged at two cantilever portions, at least one of said two cantilever portions is constituted by a combination of the lower end portions and the support portions configured into cantilever springs, and a distal end of one of the cantilever springs is engaged with a proximal end of another of the cantilever springs.

8. The push button switch in accordance with claim 1, wherein resiliently deformable portions are provided adjacent to paired engaging portions of said two frame bodies constituting said link member.

9. The push button switch in accordance with claim 8, wherein at least one of said paired engaging portions of said two frame bodies is configured into a cantilever spring.

10. The push button switch in accordance with claim 9, wherein said paired engaging portions of said two frame bodies constituting said link member are configured into cantilever springs, and a distal end of one of the cantilever springs is engaged with a proximal end of another of the cantilever springs.

11. The push button switch in accordance with claim 1, wherein two support portions of the base member supporting said link member have a receiving portion with a hook portion, and said hook portion prevents said link member from disengaging from said base member.

12. The push button switch in accordance with claim 1, wherein one of said two frame bodies constituting said link member has an L-shaped hook portion at paired engaging portions of said two frame bodies, and said L-shaped hook portion is inserted into an engaging hole of the other frame body when said two frame bodies are assembled and said L-shaped hook is bent in a predetermined direction so as to ensure engagement between said two frame bodies.

13. The push button switch in accordance with claim 1, wherein protrusions are formed at opposing inner side faces of a top end portion of each of said frame bodies constituting said link member, and said key top member has recessed portions formed at a lower surface thereof, said recessed portions mutually facing outward directions so as to be resiliently clamped by said protrusions of said two frame bodies and allowing said protrusions to rotate and slide.

14. The push button switch in accordance with claim 1, wherein a contact pushing portion is formed on a lower surface of said key top member so that said opposed switch members are pushed by said contact pushing portion.

15. The push button switch in accordance with claim 1, wherein a contact pushing portion is formed on at least one of twos frame bodies constituting said link member, so that said opposed switch members are pushed by said contact pushing portion.

16. The push button switch in accordance with claim 15, wherein said contact pushing portion is a resiliently deformable cantilever spring.

17. The push button switch in accordance with claim 1, wherein a projecting piece is provided on a lower surface of said base member, and said projecting piece is inserted into a fixing hole opened thoroughly across a rigid base plate so as to sandwich said opposed switch members between said base member and said base plate.

18. The push button switch in accordance with claim 1, wherein a resiliently deformable portion is provided adjacent to at least one of said lower end portions of said frame bodies of the link member supported by said base member, and said resiliently deformable portion is deformed along a horizontal plane.

19. The push button switch in accordance with claim 18, wherein at least one of two support portions of said base member supporting said link member is configured into a cantilever spring.

20. The push button switch in accordance with claim 18, wherein at least one of said lower end portions of said frame bodies of said link member supported by said base member is configured into a cantilever spring.

21. The push button switch in accordance with claim 18, wherein said lower end portions of the frame bodies of the link member and said two support portions of said base member are engaged at two cantilever portions, at least one of said two cantilever portions is constituted by a combination of the lower end portions and the support portions configured into cantilever springs, and a distal end of one cantilever springs is engaged with a proximal end of another of the cantilever springs.

22. The push button switch in accordance with claim 1, wherein protrusions are formed at outer side faces of a top end portion of each of said frame bodies constituting said link member, and said key top member has recessed portions formed at a lower surface thereof, said recessed portions mutually facing inward directions so as to be resiliently clamped by said protrusions of said two frame bodies and allowing said protrusions to rotate and slide.

23. A manufacturing method of push button switches comprising the steps of:

forming a plurality of base member portions continuously at predetermined pitches on a hooped elastic metal plate;

mounting each of a plurality of link members on a corresponding one of the base members portion on said hooped elastic metal plate by engaging lower end portions of said link members with support portions of corresponding one of the base member portions so that said link members are rotatably hinged about said support portions;

assembling a hooped switch member plate, having a plurality of opposed switch portions formed thereon at the same pitches as said base member portions, underneath said hooped elastic metal plate so as to adjust a mutual relationship between said base member portions and the opposed switch portions; and placing a key top member on each of the link members, thereby obtaining a plurality of push button switches connected in a hooped condition.

24. A manufacturing method of push button switches comprising the steps of:

forming a plurality of base member portions continuously at predetermined pitches on a hooped elastic metal plate;

mounting each of a plurality link members on a corresponding base member portions on said hooped elastic metal plate by engaging lower end portions of said link members with support portions of the corresponding one of the base member portion so that said link members are rotatably hinged about said support portions;

separating base member portions from said hooped elastic metal plate;

positioning said base member portions on a hooped switch member plate so as to correspond to a plurality of opposed switch portions formed thereon at predetermined pitches larger than said pitches of the continuous base member portions formed on said hooped elastic plate; and placing a key top member on each of the link members, thereby obtaining a plurality of push button switches connected in a hooped condition.

* * * * *